United States Patent [19]

Hogan

[11] Patent Number: 4,625,680

[45] Date of Patent: Dec. 2, 1986

[54] WATER CONSERVATION MEANS

[76] Inventor: Lawrence J. Hogan, 69 Berowra Waters Road, Berowra, New South Wales, Australia

[21] Appl. No.: 632,864

[22] Filed: Jul. 20, 1984

[30] Foreign Application Priority Data

Jul. 27, 1983 [AU] Australia ..... PG0507

[51] Int. Cl.[4] ..... B65G 5/00

[52] U.S. Cl. ..... 119/74; 405/55

[58] Field of Search ..... 119/73, 74, 61; 405/53, 405/54, 55

[56] References Cited

U.S. PATENT DOCUMENTS 1,952,364 3/1934 Carpita ..... 119/73 X 2,961,840 11/1960 Goldtrap ..... 405/53 X 3,736,754 6/1973 Azalbert et al. ..... 405/53

3,943,721 3/1976 Azalbert et al. ..... 405/53 X

FOREIGN PATENT DOCUMENTS 2130927 12/1971 Fed. Rep. of Germany ..... 405/55

*Primary Examiner*—Robert P. Swiatek

*Attorney, Agent, or Firm*—Nies, Webner, Kurz & Bergert

[57] ABSTRACT

A low cost apparatus for the storage of fluent materials below ground. The apparatus comprises a bore hole in the ground, a collar substantially covering the bore hole and a liner disposed within the bore hole adapted to contain the fluent material against contamination or seepage.

20 Claims, 2 Drawing Figures

WATER CONSERVATION MEANS

The present invention relates to the storage of fluent materials. It has been proposed primarily for the catchment and storage of rain-water run-off for agricultural purposes, but is also applicable to other storage requirements for example, the on-farm storage of grain.

An object of the invention is to provide storage capacity wherein the stored material is substantially sealed against contamination or evaporative loss at a minimum of expense and constructional arrangements.

The invention consists in a storage reservoir for fluent material comprising a bore-hole of circular cross-section extending into the ground from the surface thereof, an annular collar structure surrounding the mouth of the bore-hole and a pre-formed, plastics film tube with one end closed disposed in the bore hole as a liner therefore and with its other end secured to said collar structure.

Figure 1:
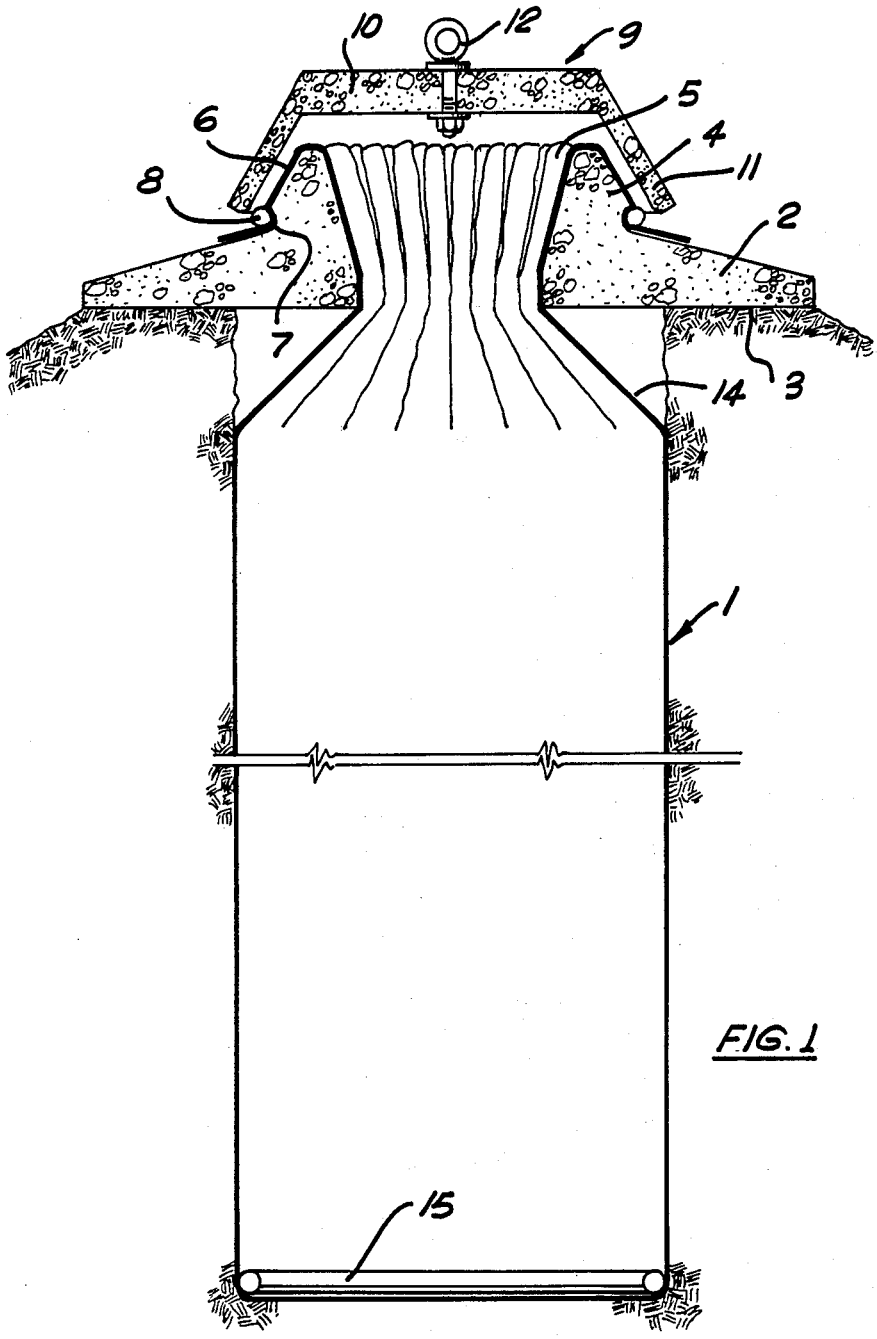
Figure 2:
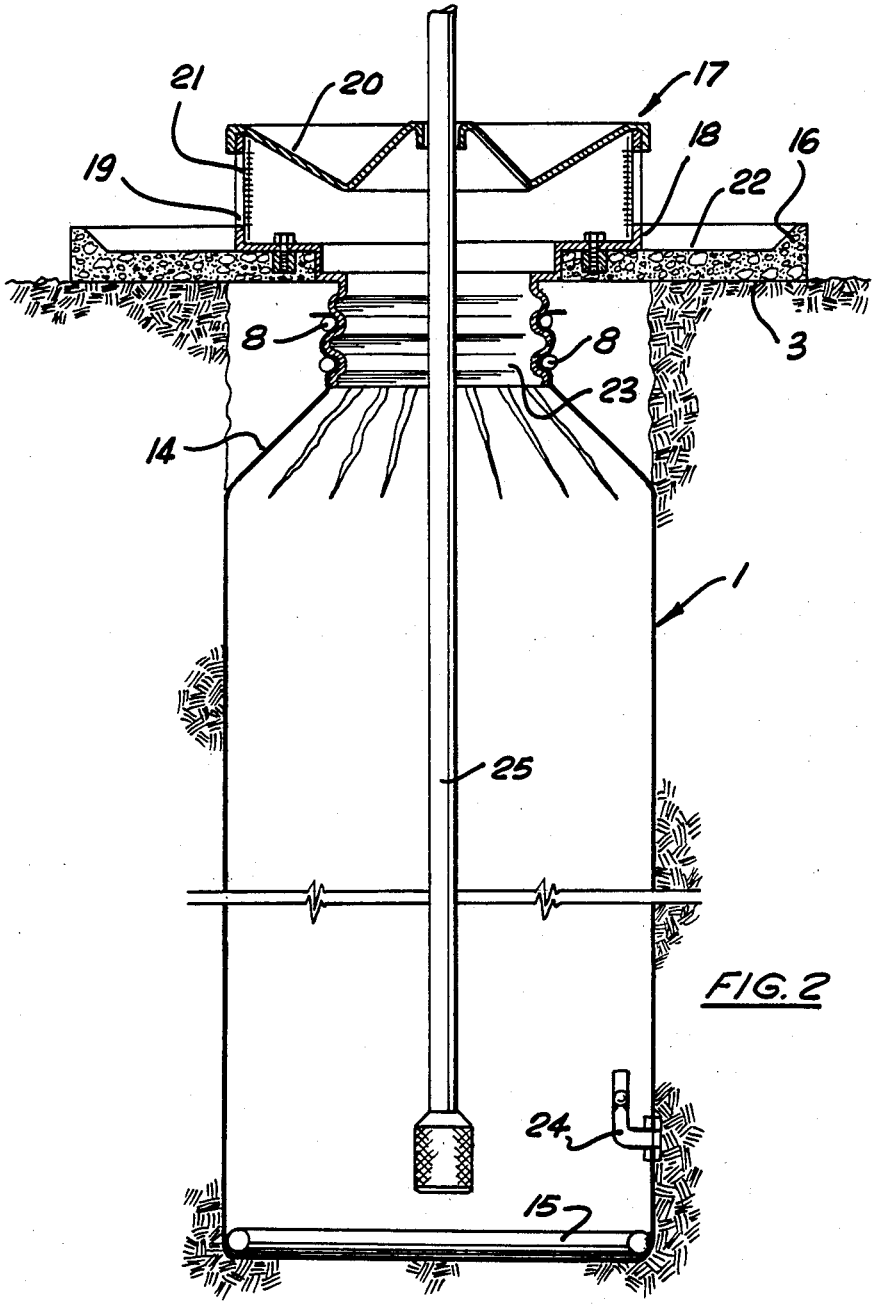

Preferred embodiments of the invention will now be described by way of example only, with reference to the accompanying drawings in which:

FIG. 1 is a sectional side elevation of a first embodiment of a storage reservoir according to the invention, and, FIG. 2 is a sectional side elevation of a second embodiment of a storage reservoir.

Referring to FIG. 1, a storage reservoir suitable for grain storage is illustrated comprising a bore hole 1 of circular cross-section extending from the surface into the ground.

A collar 2 having a flat undersurface 3 abuts the ground surface surrounding the bore hole 1 so as to seal therewith. The collar 2 comprises an upwardly projecting circular flange 4 defining a downwardly and inwardly directed conical mouth 5 and a downward and outwardly directed conical sealing surface 6.

The sealing surface 6 has a circumferential groove 7 able to accept a sealing ring 8.

A cover 9 for closing the reservoir comprises a circular plate 10 and an outwardly projecting flange 11 adapted to sealingly engage the sealing ring 8. An eye 12 is provided, fixedly attached to and upwardly projecting from the cover 6 to enable the cover 6 to be lifted out of sealing engagement with the sealing ring 8 so as to expose the mouth 5.

A preformed plastic liner 14 disposed within the bore hole 1, passes through the mouth 5 over the flange 4 and is secured within the groove 7 by the sealing ring 8.

A circular hoop 15 having an outer diameter matching that of the bore hole 1 is provided to conform the liner 14 at the bottom of the bore hole 1 before and during filling.

Referring to FIG. 2, the use of numbers to identify items corresponds to their use in FIG. 1. In FIG. 2 is a storage reservoir suitable for catchment and water storage is illustrated. This reservoir comprises a bore hole 1 of circular cross-section extending from the surface into the ground.

A collar 2 having a flat undersurface 3 abuts the ground surface surrounding the bore hole 1 so as to seal therewith. Teh collar 2 comprises an outer lip 16 projecting upwardly from the outer edge of the collar 2.

A second upstanding collar 17 constructed from fibreglass or any other suitable material is fixedly attached to the collar 2 surrounding a mouth 5. This second collar 17 comprises an inner lip 18, filter gates 19, and a watering trough 20 from which livestock may drink, enclosing the top of the second collar 17.

The filter gates 19 are adapted to slidingly engage filter screens 21 able to selectively admit run-off water through the second collar 17.

The outer lip 16 and the inner lip 18 define a toroidal entrapment trough 22 adapted to catch silt and other solid impurities before they reach the filter screens 21.

The second collar 17 also comprises a corrugated sleeve 23 projecting downwardly through the collar 2 able to accept a plurality of sealing rings 8.

A preformed plastic liner 14 disposed within the bore hole 1 is secured to the sleeve 23 by the sealing rings 8 located by the corrugations.

A circular hoop 15 is provided to conform the liner to the bore hole 1 before and during filling.

A non-return valve 4 is provided, adapted to admit ground water into the liner. This is particularly important if the bore hole 1 passes through water carrying strata in that it allows the liner 14 to fill both from the mouth 5 and the valve 24.

A siphon 25 passes through watering trough 20 and the collar 2 and into the liner 14 to facilitate the removal by pumping of any water that may be held in the reservoir.

I claim:

1. A storage reservoir for fluent material comprising a bore-hole of circular cross-section extending into the ground from the surface thereof, the bore-hole mouth periphery being adjacent the ground surface, an annular collar structure disposed at the mouth of the bore-hole with a peripheral radially outermost portion of said collar structure surrounding and extending beyond the periphery of the mouth of the bore-hole, and disposed adjacent the ground surface, and a pre-formed tube made from plastic film with one closed end disposed in the bore hole as a liner therefore and with its other open end secured to said collar structure.

2. A storage reservoir according to claim 1 wherein said collar structure includes an upwardly projecting flange defining a mouth and a sealing surface.

3. A storage reservoir according to claim 2 wherein said sealing surface includes a circumferential groove adapted to receive a sealing ring for securing said liner to said collar structure.

4. A storage reservoir according to claim 2 or 3 wherein said reservoir includes a cover comprising a circular plate and a circumferential flange adapted to mate with said sealing surface and engage said sealing ring.

5. A storage reservoir according to claim 1 wherein said collar structure comprises a second upstanding collar coaxial to and fixedly secured with said collar structure.

6. A storage reservoir according to claim 1, 2, 3 or 5, including a siphon projecting into said liner.

7. A storage reservoir according to claim 1, 2, 3 or 5, including a non return valve adapted to admit fluid into said liner from said bore hole.

8. A storage reservoir according to claim 1, 2, 3, or 5, including a circular hoop of outer diameter equal to that of said bore hole for conforming said liner at the bottom of said bore hole.

9. A storage reservoir for fluent material comprising a bore-hole of circular cross-section extending into the ground from the surface thereof, an annular collar structure surrounding the mouth of the bore-hole and a pre-formed tube made from plastic film with one closed end disposed in the bore-hole as a liner therefor and with its other open end secured to said collar structure, said collar structure comprises a second, upstanding collar coaxial to and fixedly secured with said collar structure, said second, upstanding collar comprises an inner lip abutting the collar structure, a plurality of radially disposed filter gates, and a cover engaging the anterior end of said upstanding collar.

10. A storage reservoir according to claim 9 wherein said filter gates are adapted to engage filter screens.

11. A storage reservoir according to claim 10 wherein said cover is in the form of a livestock watering trough.

12. A storage reservoir according to claim 9, 10 wherein said cover is in the form of a livestock watering trough.

13. A storage reservoir according to any one of claims 9, 10, 12 or 11 wherein said collar structure includes an upwardly projecting outer lip adjacent the outer periphery of said collar structure defining a toroidal entrapment trough between it and said inner lip.

14. A storage reservoir according to claim 13 wherein said collar structure comprises a downwardly projecting sleeve adapted to engage said liner.

15. A storage reservoir according to any one of the claims 9, 10 or 11, wherien said collar structure comprises a downwardly projecting sleeve adapted to engage said liner.

16. A storage reservoir according to claim 15 wherein said sleeve includes a plurality of circumferential corrugations each adapted to engage a tensile sealing ring, said corrugations and sealing rings adapted to secure said liner to said sleeve.

17. A storage reservoir according to any one of claims 9, 10, 12 or 1 including a siphon projecting into said liner.

18. A storage reservoir according to any one of claim 9, 10, 12 or 11 including a non return valve adapted to admit fluid into said liner from said bore hole.

19. A storage reservoir according in claims 9, 10, 12 or 11 including a circular hoop of outer diameter equal to that of said bore hole for conforming said liner at the bottom of said bore hole.

20. A storage reservoir according to claim 9, 10 or 12 wherein said sleeve includes a plurality of circumferential corrugations each adapted to engage a tensile sealing ring, said corrugations and sealing rings adapted to secure said liner to said sleeve.

* * * * *

UNITED STATES PATENT AND TRADEMARK OFFICE

CERTIFICATE OF CORRECTION

PATENT NO. : 4,625,680

DATED : December 2, 1986

INVENTOR(S) : LAWRENCE J. HOGAN

It is certified that error appears in the above-identified patent and that said Letters Patent is hereby corrected as shown below:

Column 3, line 13, should read

--12. A storage reservoir according to claim 9--.

Column 4, line 2, "9, 10 or 11," should read --9, 10, 12 or 11,--.

Column 4, line 11, "9, 10, 12 or 1" should read --9, 10, 12 or 11--.

Signed and Sealed this

Tenth Day of March, 1987

*Attest:*

DONALD J. QUIGG

*Attesting Officer*

*Commissioner of Patents and Trademarks*